US008257206B2

(12) United States Patent
Mohr et al.

(10) Patent No.: US 8,257,206 B2
(45) Date of Patent: Sep. 4, 2012

(54) BALL GAME RACKET WITH VARIABLE VIBRATION LENGTH

(75) Inventors: Stefan Mohr, Dornbirn (AT); Ralf Schwenger, Weiler-Simmerberg (DE); Johan Kotze, Wolfurt (AT); Harald Rosenkranz, Lauterach (AT)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 12/909,037

(22) Filed: Oct. 21, 2010

(65) Prior Publication Data

US 2011/0098142 A1 Apr. 28, 2011

(30) Foreign Application Priority Data

Oct. 23, 2009 (DE) ..... 10 2009 050 483

(51) Int. Cl.
*A63B 49/02* (2006.01)
*A63B 49/06* (2006.01)

(52) U.S. Cl. ..... 473/522; 473/539

(58) Field of Classification Search ..... 473/520–522, 473/524, 539–543; D21/729
See application file for complete search history.

(56) References Cited

U.S. PATENT DOCUMENTS

| | | | | | |
|---|---|---|---|---|---|
| 1,611,232 | A * | 12/1926 | Reach | 473/539 |
| 4,138,109 | A * | 2/1979 | Nobbs | 473/539 |
| 4,141,551 | A * | 2/1979 | Goransson | 473/543 |
| 4,930,778 | A * | 6/1990 | Mizuno | 473/540 |
| 5,014,987 | A * | 5/1991 | Soong | 473/537 |
| 5,220,719 | A | 6/1993 | You | |
| 5,332,213 | A * | 7/1994 | Klose | 473/522 |
| 5,350,173 | A * | 9/1994 | DiCerbo | 473/521 |
| 5,702,313 | A * | 12/1997 | Stennett | 473/546 |
| 5,944,624 | A * | 8/1999 | Davis et al. | 473/539 |
| 6,050,909 | A * | 4/2000 | Severa et al. | 473/524 |
| 6,319,158 | B1 * | 11/2001 | Cheng | 473/522 |
| 6,319,160 | B1 * | 11/2001 | Hsu | 473/540 |
| 6,432,005 | B1 * | 8/2002 | Lin | 473/540 |
| 6,811,502 | B1 | 11/2004 | Janes et al. | |
| 2006/0172827 | A1 | 8/2006 | Soekahar | |
| 2009/0017948 | A1 * | 1/2009 | Ashino | 473/522 |
| 2009/0215558 | A1 * | 8/2009 | Bothwell | 473/540 |
| 2011/0098142 | A1 * | 4/2011 | Mohr et al. | 473/522 |

FOREIGN PATENT DOCUMENTS

| | | | |
|---|---|---|---|
| DE | 35 20 335 | A1 | 4/1996 |
| DE | 10 2007 042 313 | A1 | 3/2009 |
| GB | 2 007 985 | A | 5/1979 |
| GB | 2 391 819 | A | 2/2004 |

OTHER PUBLICATIONS

Communication from the European Patent Office dated Mar. 7, 2011 for a counterpart foreign application.

* cited by examiner

*Primary Examiner* — Raleigh W. Chiu
(74) *Attorney, Agent, or Firm* — Hoffmann & Baron, LLP

(57) ABSTRACT

A ball game racket according to the present invention comprises a racket head and a racket shaft, wherein the racket head comprises a stringing having transverse strings and longitudinal strings each having a vibration length. The racket head comprises a means which reduces the vibration length of a plurality of strings on both sides of the stringing depending on the deflection of the strings. The means is attached as a separate part to the racket head.

17 Claims, 4 Drawing Sheets

BALL GAME RACKET WITH VARIABLE VIBRATION LENGTH

CROSS-REFERENCE TO RELATED APPLICATIONS

This application claims the benefit of German Application No. 10 2009 050 483.4-15, filed Oct. 23, 2009, the contents of which is incorporated by reference herein.

FIELD OF THE INVENTION

The present invention relates to a ball game racket, in particular a ball game racket having a variable string vibration length.

BACKGROUND OF THE INVENTION

Ball game rackets normally comprise a racket frame forming a racket head and a racket shank. The racket shank normally comprises a handle portion, while the racket head contains a stringing having transverse strings and longitudinal strings. The playing behavior of such ball game rackets is determined by a plurality of parameters. For example, the shape and the material of the racket frame play a role. Moreover, the strings of the stringing are apparently of specific importance because they directly interact with the ball. For example, the tension in the strings and their vibration length decisively influence the playing behavior of a ball game racket.

Conventional ball game rackets show many problems in this respect. For example, the expansion length of the string, i.e. the distance between the points at which the string is clamped, and the vibration length, i.e. the length along which the string can vibrate freely, are often identical or at least substantially identical. Moreover, the vibration length of conventional ball game rackets remains substantially constant, independent of, for example, the striking force. Finally, although in a conventional racket the string tension can be influenced during the process of applying the strings, the vibration length of the strings is generally determined by the geometry of the frame.

The present invention deals with these problems and provides a ball game racket which takes into account these problems.

SUMMARY OF THE INVENTION

A ball game racket according to the present invention comprises a racket head and a racket shank, wherein the racket head contains a stringing having transverse strings and longitudinal strings each having a vibration length. The racket head comprises a means which reduces the vibration length of a plurality of strings on both sides of the stringing depending on the deflection of the string. The means is attached to the racket head as a separate part. In other words, the separate means is not co-pressed when manufacturing the racket frame, but it can be attached to the latter subsequently. For example, the separate means can be attached to the racket frame by means of a push-in connection (e.g. by expanding eyes) or by bonding.

The vibration length is understood to be the length of the string portion that can vibrate freely. Normally, the strings of a ball game racket are attached to the racket frame by means of eyes. The vibration length of a string attached in this manner then corresponds substantially to the distance between two opposite eyes. According to the present invention, this vibration length is reduced depending on the deflection of the string. This means that in the rest position at first the complete vibration length is available to the string, i.e. substantially the distance between the two opposite eyes. However, if the string is deflected, for example because a ball hits the stringing, the vibration length is reduced by the means of the present invention. In other words, starting from a predetermined string deflection, the string can no longer vibrate or be deflected further across its complete length, but only a reduced portion of the string is then available for a further deflection of the string. This string reduction associated with the increase in the string deflection can be either discrete or continuous. For example, it is possible to reduce the vibration length abruptly at a predetermined string deflection by a predetermined amount. Alternatively, the vibration length can be reduced continuously as the string deflection increases. The vibration length can also be reduced in a stepped manner in two, three or more steps or almost continuously in a plurality of steps. It is intended to reduce the vibration length on both sides of the stringing. This means that the vibration length is reduced irrespective of the direction of the string deflection.

The ball game racket according to the present invention is advantageous because when the ball hits the stringing, at first the complete vibration length of the strings is available, while as the string deflection increases, the vibrating or active length of the string is reduced. Thus, the stringing is curved more strongly and the ball is more completely enclosed by the stringing. Thus, the ball can be controlled better and, in particular, its flight direction can be more easily determined.

According to the invention, it is intended to attach the means for reducing the vibration length as a separate part to the racket head. Thus, this means can be easily exchanged. This has many advantages. On the one hand, this means for reducing the vibration length of the strings is subject to a great mechanical stress, which can lead to signs of wear after a certain time period. In this case, this means can be easily dismounted from the ball game racket and replaced by a new spare part. On the other hand, the realization as a separate part offers the possibility to adapt the striking and ball control behavior of the ball game racket of the present invention as required. Thus, the player can select a means which reduces the vibration length by a specific amount convenient to him/her. Whenever a new stringing is attached to the racket, at the same time also the means for reducing the vibration length can be exchanged and, for example, be replaced by a means which reduces the vibration length more strongly or less strongly or reduces the vibration length discretely or continuously. Thus, the ball game racket of the present invention can be used extremely flexibly.

According to a preferred embodiment of the ball game racket of the present invention, the means for reducing the vibration length has an opening through which the plurality of strings extend. Preferably between 2 and 10 strings, particularly preferably between 4 and 8 strings, can extend through the opening. Thus, the opening has the shape of a gap whose length is determined such that the plurality of strings can extend through it. In a direction perpendicular with respect to the stringing plane, the opening is preferably larger than the string diameter. This means that the width of the gap is dimensioned such that the strings can be passed through it without contacting the gap. Thus, in their rest position, the strings are not influenced or affected by the means. Only when the strings are deflected by a predetermined amount do they come in contact with the means or the edge of the gap-shaped opening, which then interacts mechanically with the string. In this state, the vibration length of the strings extending through the opening is substantially defined by the point of contact with the means or the edge of the opening. In a direction perpendicular with respect to the stringing plane, the opening is preferably between 1 mm and 10 mm, particularly preferably between 2 mm and 5 mm. For example, if the gap width is 3 mm and the string diameter is 1 mm, the string, when being arranged centrally in the opening, can be deflected by one millimeter before it interacts with the edge of the opening.

If a free string vibration up to relatively large string deflections should be possible, it is only necessary to increase the gap width. Vice versa, a smaller gap width already leads to an effect in case of relatively small string deflections. Although it is preferred to mount the strings centrally with respect to the opening, it is also possible to attach the means according to the present invention asymmetrically. In this case, the vibration length is reduced at different string deflections, depending on the direction in which the string is deflected.

Preferably, the vibration length is reduced symmetrically at both sides of the stringing. Alternatively, the means can also be realized such that the vibration length is reduced more strongly at one string of the stringing than at the other string of the stringing. The vibration length is reduced preferably by 2 mm to 20 mm, particularly preferably by 5 mm to 10 mm. To this end, the means is preferably spaced from the inner side of the racket head. At the racket head, the racket frame normally comprises an inner side and an outer side. The free vibration length of the strings is predetermined substantially by the distance between inner side and inner side. Spacing the means from the inner side of the racket head towards the center of the racket head leads to a respective reduction in the vibration length. Here, the distance between the means and the inner side of the racket head is preferably between 2 mm and 20 mm, particularly preferably between 5 mm and 10 mm.

According to a particularly preferred embodiment of the ball game racket of the present invention, the racket head comprises a plurality of means for reducing the vibration length. Particularly preferably, 2 or 4 of such means are provided. These means are preferably arranged symmetrically with respect to the longitudinal axis of the racket. Moreover, the strings passed through the means for reducing the vibration length are preferably transverse strings. According to an embodiment, the racket head comprises means at about 3 o'clock and at about 9 o'clock. According to a further embodiment, the racket head comprises means between about 1 o'clock and 3 o'clock and between about 9 o'clock and 11 o'clock. Alternatively or additionally, the racket head comprises means between about 3 o'clock and 5 o'clock and between about 7 o'clock and 9 o'clock.

BRIEF DESCRIPTION OF THE DRAWINGS

In the following, particularly preferred embodiments according to the invention are described in more detail on the basis of the Figures in which.

DETAILED DESCRIPTION OF THE INVENTION

Figure 1:
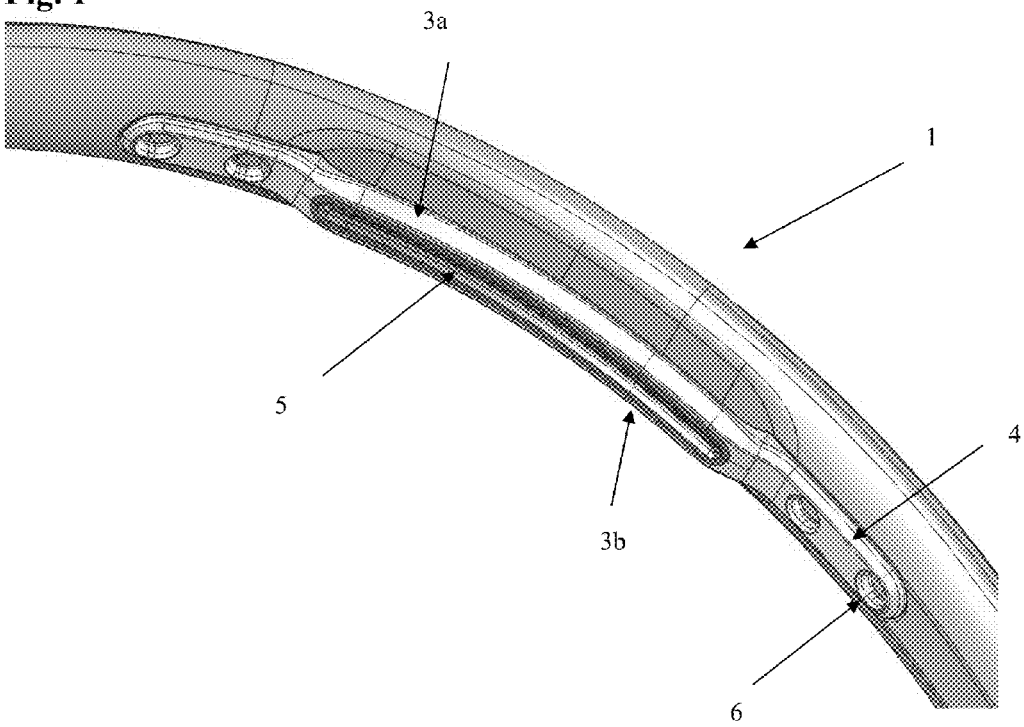
FIG. 1 is a perspective view of a portion of the racket head of a ball game racket comprising a means according to the present invention.
Figure 3:
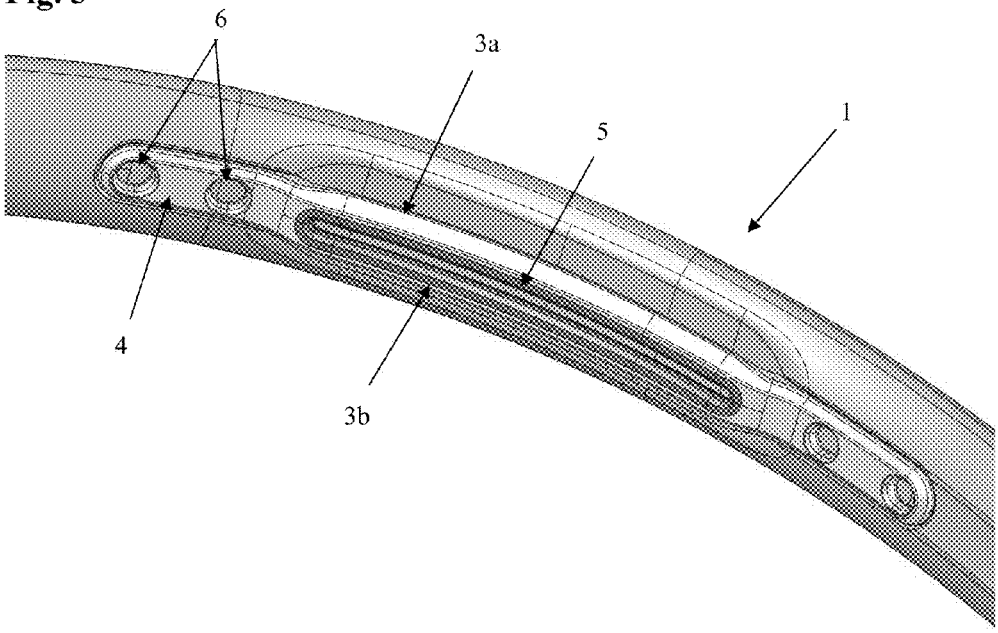
FIG. 3 is a perspective view of a portion of the racket head of a ball game racket comprising a means according to the present invention.

FIGS. 1 and 3 show a perspective view of a portion of the racket head 1. A separate part 2 (see FIG. 4) is attached to the racket head 1. The separate part 2 comprises a means 3 for reducing the vibration length of a plurality of strings, which means 3 can be attached by means of the attachment portion 4 to the frame 1 of the racket head. The attachment can be realized by means of a snap-fit connection or a lock-in mechanism, by means of a push-in connection or also by screwing. To this end, for example, screws can be screwed through the openings 6 or the openings 6 can engage with pins (not shown) at the racket frame 1. Alternatively, the separate part 2 can be attached to the racket frame 1 by means of specific adhesives. For example, the adhesives 3M DP 190 and 3M DP 490 are suitable for this purpose. In case of bonding, the openings 6 in the separate part 2 are of course not necessary if these openings 6 are not required for passing strings of the stringing through them. In any case, the separate part 2 should be attached to the frame portion 1 of the racket such that the separate part 2 can take up the forces transmitted to it by the strings.

The means 3 for reducing the vibration lengths of the strings comprises two portions 3*a* and 3*b* between which a gap-shaped opening 5 is provided. A plurality of strings can be passed through this gap-shaped opening 5. The width of the gap-shaped opening 5 is selected such that the strings can at first be passed between the portions 3*a* and 3*b* through the opening 5 without any contact. Any interaction between the portions 3*a* and 3*b* and the strings, for example a damping, should be avoided at least in the rest position of the strings. Only when the strings are deflected in one or the other direction do they come in contact with the portion 3*a* or 3*b* of the means 3 and are thus influenced by the respective portion in case of a further deflection. The end of the freely vibrating portion of the strings is then formed or defined substantially by the portions 3*a* and 3*b*.

Figure 2:
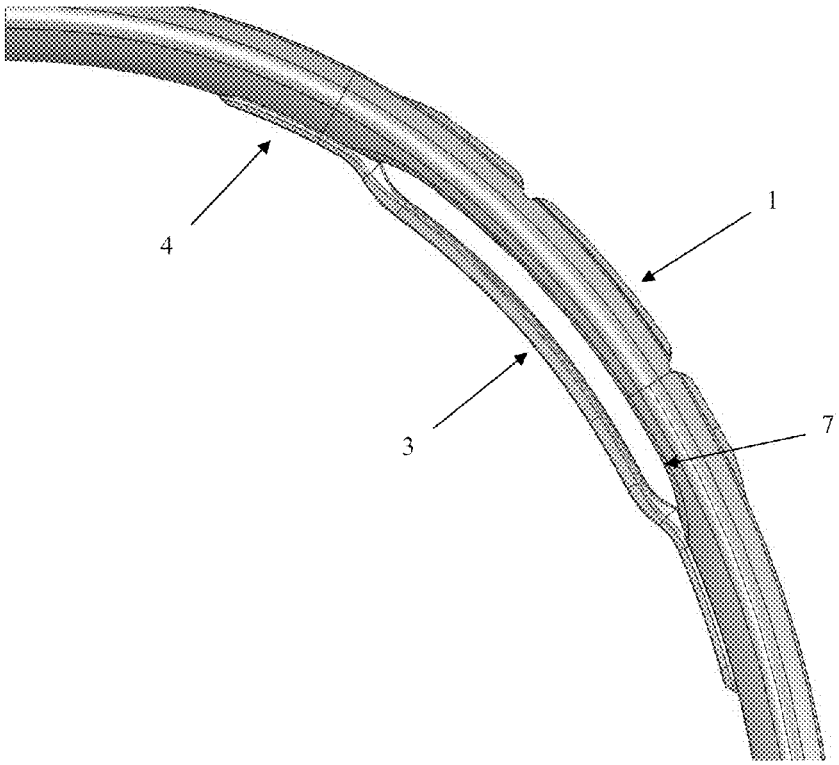
FIG. 2 is a side view of a portion of the racket head of a ball game racket comprising a means according to the present invention.

It is clearly evident from the side view of FIG. 2 that the frame portion 1 preferably comprises a depression or recess 7 in the area in which the means 3 is attached. In other words, the inner surface of the racket head 1 is displaced outwardly in this portion. Thus, first the effective string length is increased in this portion. The effect of the string reduction is thus increased considerably by the means 3. However, it is also possible to use the means 3 in a racket head having no impression or recess. However, the shown preferred embodiment is particularly advantageous because when the ball hits the stringing, at first a particularly large vibration length is available, which is then accordingly reduced as the strings are deflected further.

In particular thermoplastic elastomers, polycarbonate, polyamide and further plastics are suitable as materials for the separate part 2. A particularly preferred material is a mixture of ABS and polyamide marketed under the name "Terblend". Preferably, the material is sufficiently flexible or elastic for damping the strings to some extent. Thus, the discrete transition from a long vibration length to a short vibration length is dampened to a continuous transition.

Figure 4:
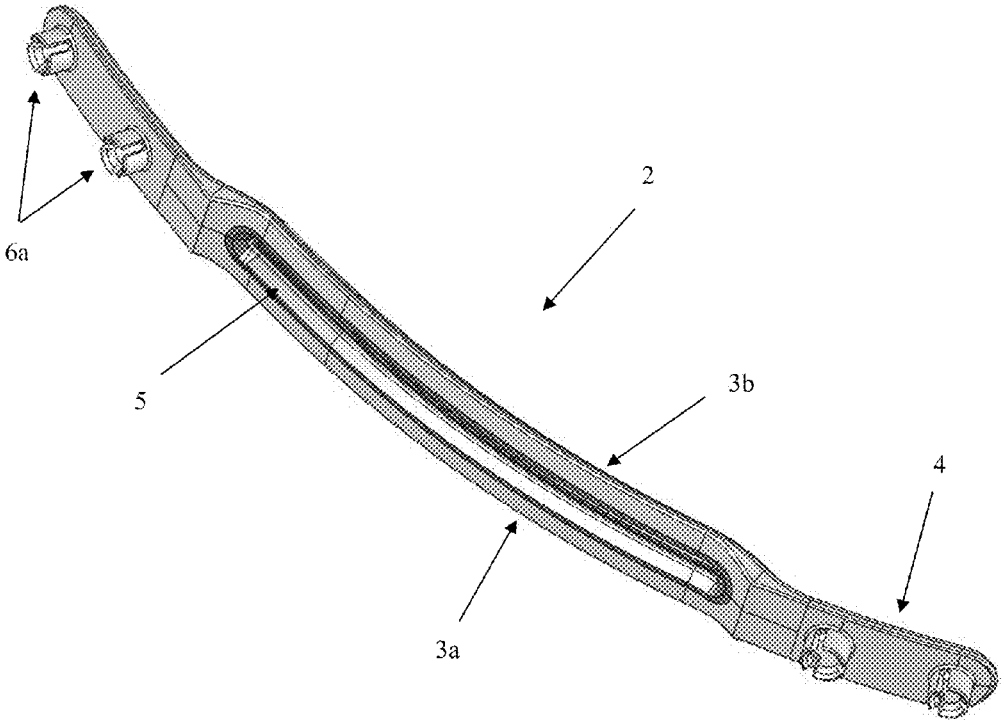
FIG. 4 is a perspective view of a preferred embodiment of the means according to the present invention.
Figure 5:
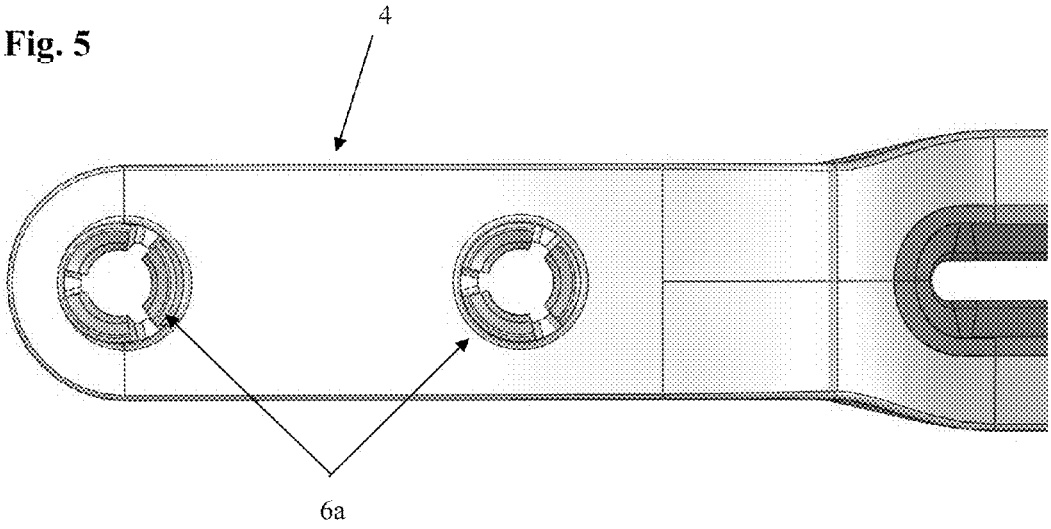
FIG. 5 is a rear view of the attachment portion of a preferred embodiment of the means according to the present invention.
Figure 6:
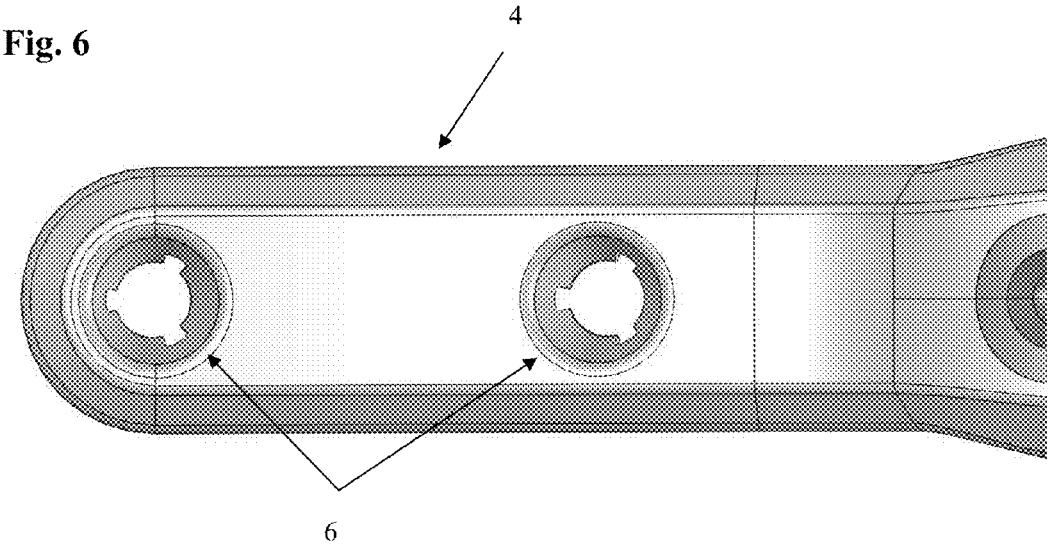
FIG. 6 is a front view of the attachment portion of a preferred embodiment of the means according to the present invention.
Figure 7:
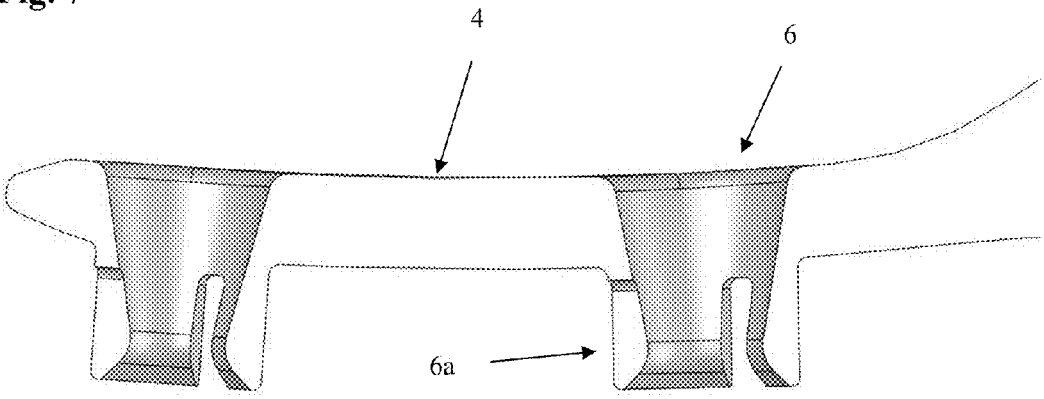
FIG. 7 is a sectional view of the attachment portion of a preferred embodiment of the means according to the present invention.
Figure 8:
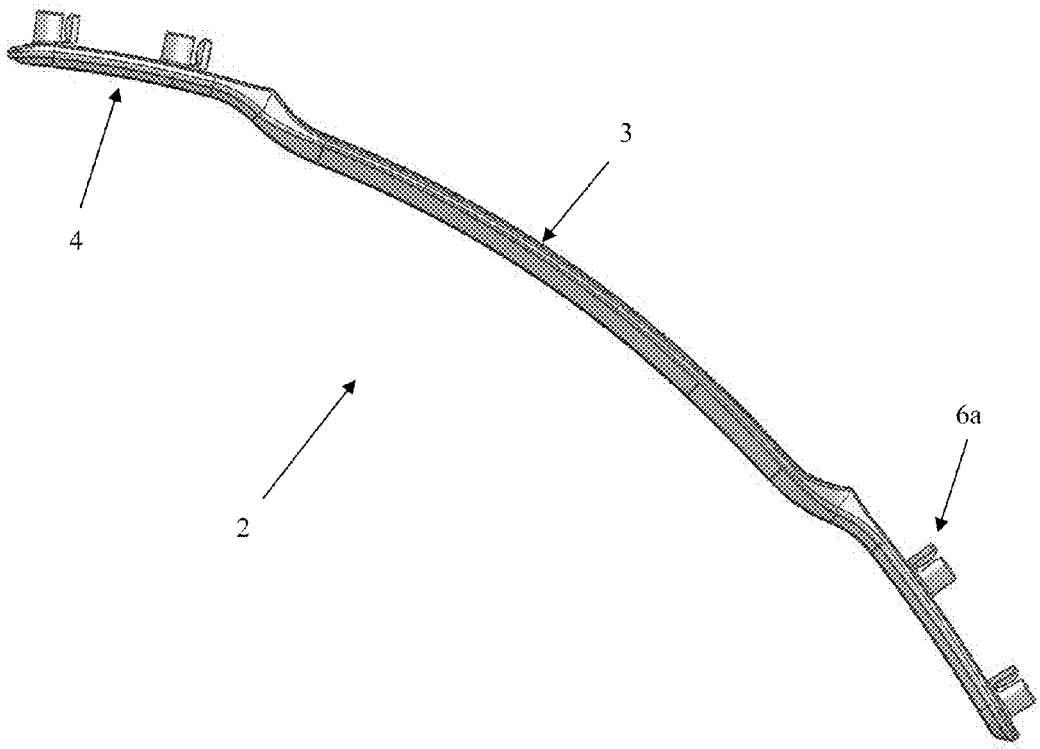
FIG. 8 is a side view of a preferred embodiment of the means according to the present invention.

A perspective view of a preferred embodiment of the means 2 according to the present invention is shown in FIGS. 4 and 8. The separate part 2 comprises a means 3 for reducing the vibration length of a plurality of strings, which means 3 can be attached to the frame 1 of the racket head by means of two attachment portions 4. The means 3 for reducing the vibration lengths of the strings comprises two portions 3*a* and 3*b* between which a gap-shaped opening 5 is provided. As described above, a plurality of strings can be passed through these gap-shaped openings 5. The attachment portions 4, which are shown in FIGS. 5, 6 and 7 in rear, front and sectional views, respectively, comprise two openings 6 which are provided at the rear side with expansion eyes 6*a*. When mounting the outer eye band, its eyes press through the expansion eyes 6*a* and expand them so that a barb is formed, which barb attaches the means 2 to the racket frame.

The shown preferred embodiment is only an exemplary realization of the means according to the invention. For instance, the means 3 can have a different shape and different dimensions. In particular, the means 3 can also be asymmetric in that, for example, the two portions 3*a* and 3*b* are spaced to different extents from the strings or, for instance, project to different extents towards the center of the racket head. Thus, the string can be reduced either at different extents of deflections or to a different extent, depending on the direction of the string deflection. Also the attachment portions 4 of the separate part 2 can have different shapes, depending on how the attachment to the racket head 1 should be realized.

As described above, the ball game racket according to the present invention provides for a good playing behavior and a good ball control and can be used extremely flexibly. In particular, different separate parts 2 can be attached to the racket head 1 as required.

The invention claimed is:

1. A ball game racket comprising a racket head (1) and a racket shaft, wherein the racket head contains a stringing having transverse strings and longitudinal strings each having a vibration length, wherein the racket head (1) is provided with a means (3) which reduces the vibration length of a plurality of strings on both sides of the stringing depending on the deflection of the strings, wherein the means (3) is attached as a separate part (2) to the racket head, and wherein the means (3) is spaced from the racket head.

2. The ball game racket according to claim 1, wherein the means (3) comprises an opening (5) through which the plurality of strings extend.

3. The ball game racket according to claim 2, wherein in a direction perpendicular with respect to the stringing plane, the opening (5) is larger than the string diameter.

4. The ball game racket according to claim 3, wherein the opening (5) is between 1 mm and 10 mm.

5. The ball game racket according to claim 3, wherein the opening (5) is between 2 mm and 5 mm.

6. The ball game racket according to claim 2, wherein the plurality of strings is between 2 and 10 strings.

7. The ball game racket according to claim 2, wherein the plurality of strings is between 4 and 8 strings.

8. The ball game racket according to claim 1, wherein the plurality of strings are transverse strings.

9. The ball game racket according to claim 1, wherein the vibration length is reduced symmetrically at both sides of the stringing.

10. The ball game racket according to claim 1, wherein the vibration length is reduced by 2 mm to 20 mm.

11. The ball game racket according to claim 10, wherein the vibration length is reduced by 5 mm to 10 mm.

12. The ball game racket to according to claim 1, wherein the means is spaced from the inner side of the racket head.

13. The ball game racket according to claim 1, wherein a plurality of means are provided at the racket head.

14. The ball game racket according to claim 13, wherein the plurality of means are arranged symmetrically with respect to the longitudinal axis of the racket.

15. The ball game racket according to claim 13, wherein the racket head comprises means at one or a combination of the following positions: at about 3 o'clock and/or at about 9 o'clock; between about 1 o'clock and 3 o'clock and/or between about 9 o'clock and 11 o'clock; between about 3 o'clock and 5 o'clock and/or between about 7 o'clock and 9 o'clock.

16. The ball game racket according to claim 13, wherein the plurality of means includes two or four means.

17. A ball game racket comprising a racket head (1) and a racket shaft, wherein the racket head contains a stringing having transverse strings and longitudinal strings each having a vibration length, wherein the racket head (1) is provided with a means (3) which reduces the vibration length of a plurality of strings on both sides of the stringing depending on the deflection of the strings, wherein the means (3) is attached as a separate part (2) to the racket head, and wherein the means is spaced from the inner side of the racket head.

* * * * *